US009175482B2

(12) United States Patent
Olma et al.

(10) Patent No.: US 9,175,482 B2
(45) Date of Patent: Nov. 3, 2015

(54) INTERLOCKING WALL PANEL WITH MACHINE CARVED DECORATIVE TEXTURE

(71) Applicant: Heartwood Carving, Inc., Eugene, OR (US)

(72) Inventors: Joe Olma, Eugene, OR (US); Martin Grant, Eugene, OR (US); Janet Whitlow, Eugene, OR (US)

(73) Assignee: Heartwood Carving, Inc., Eugene, OR (US)

( * ) Notice: Subject to any disclaimer, the term of this patent is extended or adjusted under 35 U.S.C. 154(b) by 0 days.

(21) Appl. No.: 13/842,675

(22) Filed: Mar. 15, 2013

(65) Prior Publication Data

US 2014/0260058 A1 Sep. 18, 2014

(51) Int. Cl.

| | |
|---|---|
| ***E04B 2/00*** | (2006.01) |
| ***E04F 13/08*** | (2006.01) |
| ***E04F 13/10*** | (2006.01) |

(52) U.S. Cl.

CPC ..... *E04F 13/0871* (2013.01); *E04F 13/0894* (2013.01); *E04F 13/10* (2013.01)

(58) Field of Classification Search

CPC . E04F 13/0894; E04F 15/02038; E04F 15/02; E04B 1/54; E04B 2/00; E04B 1/80; B44F 9/02; B27M 1/08; B27M 1/003; Y10T 29/5136

USPC ..... 52/588.1, 589.1, 590.2, 311.1, 313, 52/316; 428/156; 144/360, 363, 368

See application file for complete search history.

(56) References Cited

U.S. PATENT DOCUMENTS

| | | | | | |
|---|---|---|---|---|---|
| 2,724,642 | A * | 11/1955 | Brown | 428/151 |
| 3,247,047 | A * | 4/1966 | Buckley | 428/151 |
| 3,987,599 | A * | 10/1976 | Hines | 52/591.1 |
| 4,388,788 | A * | 6/1983 | Bosco | 52/390 |
| 4,464,872 | A * | 8/1984 | Eaton | 52/276 |
| 6,093,356 | A * | 7/2000 | Albertelli | 264/247 |
| 7,108,031 | B1 * | 9/2006 | Secrest | 144/358 |
| 8,250,832 | B2 * | 8/2012 | Sjoberg | 52/747.1 |
| 8,474,209 | B2 * | 7/2013 | Garcia | 52/391 |
| 2004/0200164 | A1 * | 10/2004 | Schrunk | 52/311.1 |
| 2007/0051063 | A1 * | 3/2007 | Sabater et al. | 52/592.1 |
| 2008/0184647 | A1 * | 8/2008 | Yau | 52/589.1 |
| 2013/0091788 | A1 * | 4/2013 | Lee et al. | 52/177 |

* cited by examiner

*Primary Examiner* — Brian Glessner
*Assistant Examiner* — Paola Agudelo
(74) *Attorney, Agent, or Firm* — Alleman Hall McCoy Russell & Tuttle LLP

(57) ABSTRACT

An interlocking wall panel with machine carved decorative texture is provided. An interlocking wall panel may comprise a body comprising a wooden material. The wooden material may be solid wood or any of a variety of engineered wood product or laminates thereof. The body may have a carved top surface. A first side of the body may have an interlocking groove formed therein, and a second side substantially parallel to the first side may have an interlocking tongue extending therefrom. A pair of opposed ends may form a perimeter of the body with the first and second sides. The carved top surface of the interlocking wall panel may include a texture comprising a plurality of decorative grooves. The decorative grooves may vary in depth along their length and may furthermore vary in width. Each of the ends of the body may include respective matching end profiles.

16 Claims, 20 Drawing Sheets

INTERLOCKING WALL PANEL WITH MACHINE CARVED DECORATIVE TEXTURE

BACKGROUND

Wood paneling is used to enhance the aesthetic appeal of many environments. Wood paneling may be manufactured from solid wood or plywood, for example, and may include a natural wooden exterior surface, or in some cases an exterior surface featuring a smooth plastic laminate with a wood design imprinted thereon. Natural wood surfaces are typically sanded smooth and finished with paint or stain.

To enhance appearance, in some cases it may be desirable to provide texture to the wood paneling, for visual interest. One manner of providing such texture is to select the wood and finish in a combination that allows the grain to stand up and show through the finish. However, this approach produces a texture that is very shallow, which makes light play on the texture virtually unnoticeable. Another manner of providing texture is to utilize panels manufactured from unfinished, rough sawn boards. While this approach gives slightly more light play on the exterior surface, it results in a rustic appearance which is not always desirable. Yet another manner of providing texture, as shown in Prior Art Document 1, is to use a molding knife to uniformly cut along the panel lengths to impart a shaped groove. While this approach may be desirable in some applications where a uniform grooved pattern is desired, it cannot produce patterns that appear natural and organic to the user.

Prior Art Document 1: Cabinetmaking and Millwork

SUMMARY

An interlocking wall panel with machine carved decorative texture is provided. The interlocking wall panel may comprise a body formed of a wooden material. The wooden material may include solid wood or any of a variety of engineered wood products. Furthermore, the body may be a laminate of layers of wooden materials.

The body may have a carved top surface. A first side of the body may have an interlocking groove formed therein, and a second side substantially parallel to the first side may have an interlocking tongue extending therefrom. A pair of opposed ends may form a perimeter of the body with the first and second sides.

The carved top surface of the interlocking wall panel may include a texture comprising a plurality of decorative grooves. The decorative grooves may curve in at least one of three orthogonal dimensions (width, depth, or height) along their lengths, and sometimes in a combination of these dimensions. In some embodiments, the decorative grooves may be linear. Each of the plurality of decorative grooves may be formed at an independent depth or at an independent width, and along an independent curvilinear path. Furthermore, the decorative grooves may include compound grooves that are comprised of at least two grooves formed on top of each other.

Each groove is typically formed by an independent pass of a cutting tool along the top surface, which removes material from the body. In one example, the cutting tool may be an end mill of a 3 or 5 axis computer numerically controlled (CNC) milling machine, and the end mill may be ball shaped. In some cases, each decorative groove has a cross section that formed by the same tool, and the shape of the cross section of each curve varies with the depth of the tool cut, and with the removal of material by adjacent or overlying cuts in subsequent or prior tool cuts. In other cases, more than a plurality of cutting tools each having a different shape may be applied to cut the grooves in a single body.

Each of the ends of the body may include respective matching end profiles. When assembled into an interlocking wall panel system wherein the interlocking wall panels may be laid out end to end, the ends of each pair of adjacent panels meet with matching end profiles to form a seamless joint therebetween. Furthermore, each of the first and second sides of each of the panels in each of the rows may include a matching side profile, and as a result a seamless joint may be achieved between each of the adjacent pairs of rows.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1A:
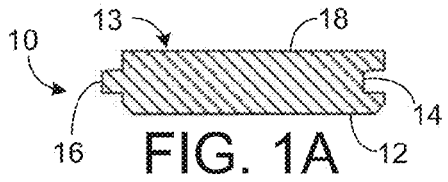
FIG. 1A is a left end view of an interlocking wall panel with machine carved decorative texture.

FIGS. 1A-1F show a first embodiment of interlocking wall panel 10 with a top surface 12 to which a machine carved decorative texture 13 is applied. Illustrations of a first embodiment of a particular decorative texture 13 that may be applied to the top surface 11 are illustrated in detail in FIGS. 2, 3, 3A, 6A, and 7. Variations to the carved decorative texture 13 are possible, a second embodiment featuring a second carved decorative texture is shown in FIGS. 11-14, a third embodiment featuring a third carved decorative texture is shown in FIGS. 15-18, and a fourth embodiment featuring a fourth carved decorative texture is shown in FIGS. 19-22. It will be appreciated that the overall, structural features of the interlocking wall panel 10 will be described with reference to FIGS. 1A-1F and examples of other decorative textures 13 will be described further herein below.

The interlocking wall panel 10 in accordance with the present disclosure has a body 11 comprising a wooden material. The wooden material may be an engineered wood product, which may be, for example, medium density fiber board, oriented strand board, plywood, particle board, glued laminated timber, laminated veneer lumber, parallel strand lumber, or laminated strand lumber. Furthermore, the body of an interlocking wall panel may be solid wood. In addition, the body 11 may be laminated of a plurality of layers, and the layers may be solid wood, or an engineered wood product. Thus, in some embodiments, the body may be formed of three layers, illustrated by dashed lines in FIG. 1E, and the top layer 20 may be a fine grade of solid wood, and the bottom layers 21 and 22 may be engineered wood product, or a lesser grade of solid wood, to economize manufacturing costs while presenting a high quality appearance of the visible surface to which the decorative texture 13 is applied.

The wooden material of the interlocking wall panel 10 may be formed from dimensioned lumber. The dimensioned lumber forming the interlocking wall panel 10 may have a cross-sectional shape that is bordered by an idealized bounding box with an aspect ratio of 1"×4", 1"×6", 1"×8", or 1"×10" for example. It should be understood that though referred to by the above listed dimensions, a finished product will have smaller actual dimensions. For example a, so-called, 1"×4" will have true dimensions of ¾"×3½", and a so-called 1"×6" may have actual dimensions ¾" by 5½" These dimensions may be further altered by the process of forming an interlocking wall panel in which an interlocking tongue and groove and carved top surface may be formed. The bounding box aspect ratio is provided to give reference to the starting size of the wooden material prior to manufacture.

FIG. 1A shows a back end of the interlocking wall panel 10. From the back end a profile of an interlocking groove 14 and interlocking tongue 16 are visible. A cross sectional profile of the interlocking groove and a cross sectional profile of the interlocking tongue match. The interlocking tongue and groove may comprise a variety of joint types or profiles including square, rectangular, dovetail, biscuit joint, or beveled.

Figures 1B, 1C, 1D:
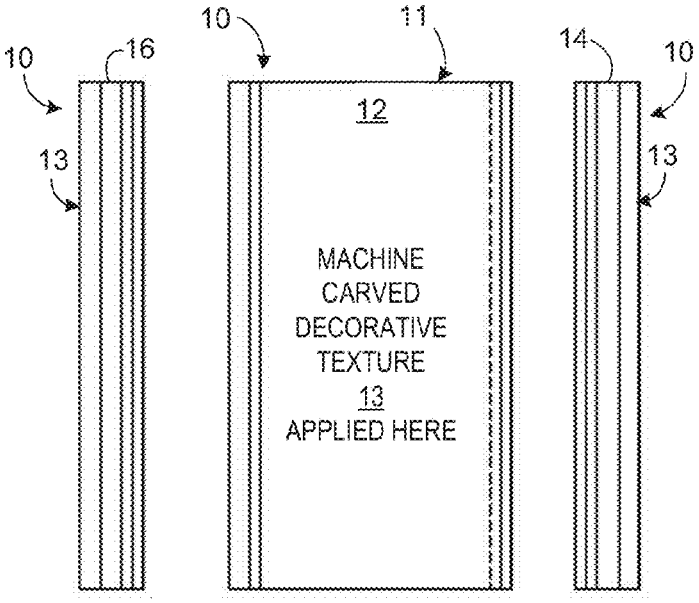
FIG. 1B is a front side view of the interlocking wall panel with machine carved decorative texture of FIG. 1A.
FIG. 1C is a top view of the interlocking wall panel with machine carved decorative texture of FIG. 1A.
FIG. 1D is a back side view of the interlocking wall panel with machine carved decorative texture of FIG. 1A.
Figure 1E:
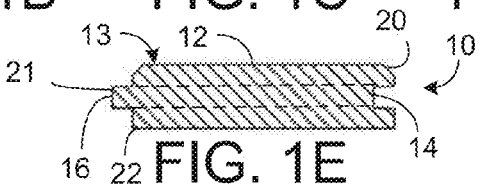
FIG. 1E is a right end view of the interlocking wall panel with machine carved decorative texture of FIG. 1A.

FIG. 1B shows a left side view of an interlocking wall panel 10 with machine carved decorative texture. The left side view shows, in this example, the interlocking tongue. However, it should be understood that the interlocking tongue and the interlocking groove may be arranged on either side of the interlocking wall panel so long as an interlocking groove in a first side of the body of the interlocking wall panel and an interlocking tongue extending from a second side of the body substantially parallel to the first side are formed.

Figure 4:
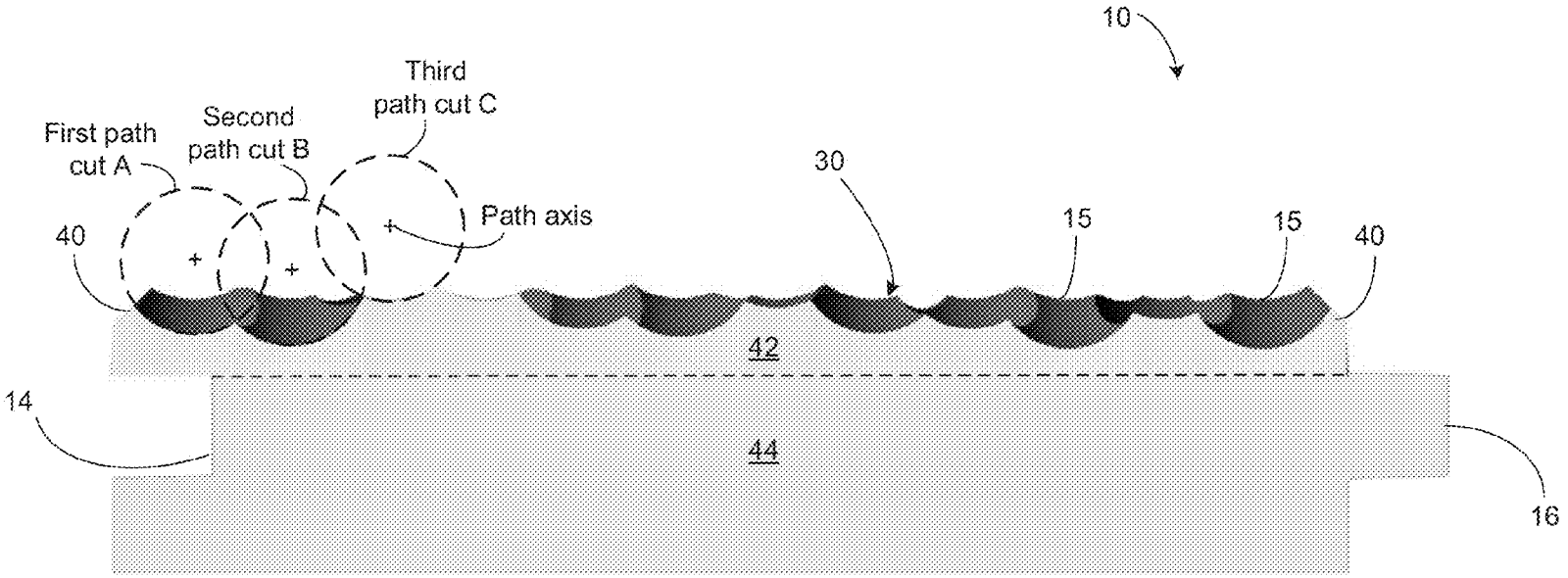
FIG. 4 is an end view of the interlocking wall panel of FIG. 2.

FIG. 1C shows a top view of an interlocking wall panel 10 with machine carved decorative texture 13. The carved decorative texture 13 on the top surface 11 may include a texture comprising a plurality of decorative grooves 15. The decorative grooves are typically curvilinear and may curve in at least one of three orthogonal dimensions (width, depth, or height) along their lengths, and sometimes in a combination of these dimensions. Thus, where the X-Y plane represents the idealized top surface of the body, the curve of each groove may be in the X-Y plane, Y-Z plane, or Z-X plane, or in a combination thereof. Each of the plurality of decorative grooves may be formed at an independent depth or at an independent width, and with an independent curvature along their lengths. Furthermore, the decorative grooves may include compound grooves that are comprised of at least two grooves formed on top of each other. A first (shallower) cut path A, a second (deeper) cut path B and a third (shallowest) cut path C of a ball end mill forming such a compound groove are illustrated in FIG. 4. It will be appreciated that when a ball end mill is used, the arcs formed in the top surface will meet with each other in sharp corners, although these sharp corners may be smoothed by later finishing (sanding, sand blasting, etc.).

In the first embodiment shown in FIGS. 2-5, the decorative grooves are curvilinear and vary in depth along their length. Further, each of the plurality of decorative grooves is formed at an independent depth, hence the depth of the grooves varies, as best seen in FIG. 4. Alternatively, or in addition, each of the plurality of decorative grooves may be formed at an independent width. Furthermore, the decorative grooves may include compound grooves that may be comprised of at least two grooves formed on top of each other. Thus, at least one upper groove and one lower groove are typically included in the compound groove, and these upper and lower grooves may be laterally spaced apart by a lateral offset.

As shown in FIG. 4, the body of the first embodiment of the interlocking wall panel 10 includes a top layer 42 of a first wooden material, and one lower layer 44 of a second wooden material, and the decorative grooves in the top surface are formed entirely within the first layer of the first wooden material. In alternative embodiments, as described above and shown in FIG. 1E, more than one lower layer may be provided. In other embodiments, the layers may be made of the same wooden material. The patterned or textured surface 12 of an interlocking wall panel of the present disclosure may be formed as a milled cut, as opposed to formation by a wire brush or a molding knife. Furthermore, a milled cut used in forming the decorative grooves may be made into the surface of the material. An example cut may be made by a ½" round ball end drill bit affixed to a CNC milling machine. The decorative pattern of surface 12 is formed of a plurality of cuts. This is in contrast to a pattern that may be made by a molding knife, where the pattern is created in the knife and extruded along the length of the piece. The texture of surface 12 appears organic and natural; however, the same techniques may be applied to produce textures that are appear as geometric patterns, as discussed below.

Turning now to FIG. 1D a right side view of the interlocking wall panel 10 with machine carved decorative texture 13 is shown. In this view the interlocking groove 14 is shown. As described above, the groove may assume many shapes or configurations as well as vary in width, depth or alignment along the edge of the interlocking wall panel.

In reference to FIG. 1D, a front end view of an interlocking wall panel with machine carved decorative texture is shown. As seen in the back end view of FIG. 1*a*, one side of the interlocking wall panel comprises an interlocking tongue 16, and an opposing side comprises an interlocking groove 14. In an interlocking wall panel system comprised of a plurality of interlocking wall panels arranged in stacked rows, each pair of adjacent rows is interlocked in a tongue and groove connection between the interlocking tongues of the panels in a first of the pair of rows and the interlocking groove of the panels in a second of the pair of rows.

Figure 1F:
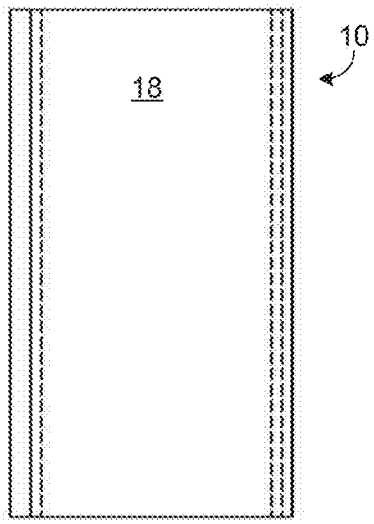
FIG. 1F is a bottom view of the interlocking wall panel with machine carved decorative texture of FIG. 1A.

Turning now to FIG. 1F, a bottom view of an interlocking wall panel with machine carved decorative texture is shown. In an interlocking wall panel system, the bottom surface 18 forms the exterior facing surface of the interlocking wall pall that may be bonded or otherwise adhered or faced to a wall or other structure surface. The bottom surface of the interlocking wall panel may be unfinished, or comprise a texture suitable for application of adhesive used in applying to a wall surface. In addition to use on interior wall surfaces an interlocking wall panel system in accordance with the present disclosure may be used as decoration of ceilings, bars, cabinets, or furniture as non-limiting examples.

Figure 2:
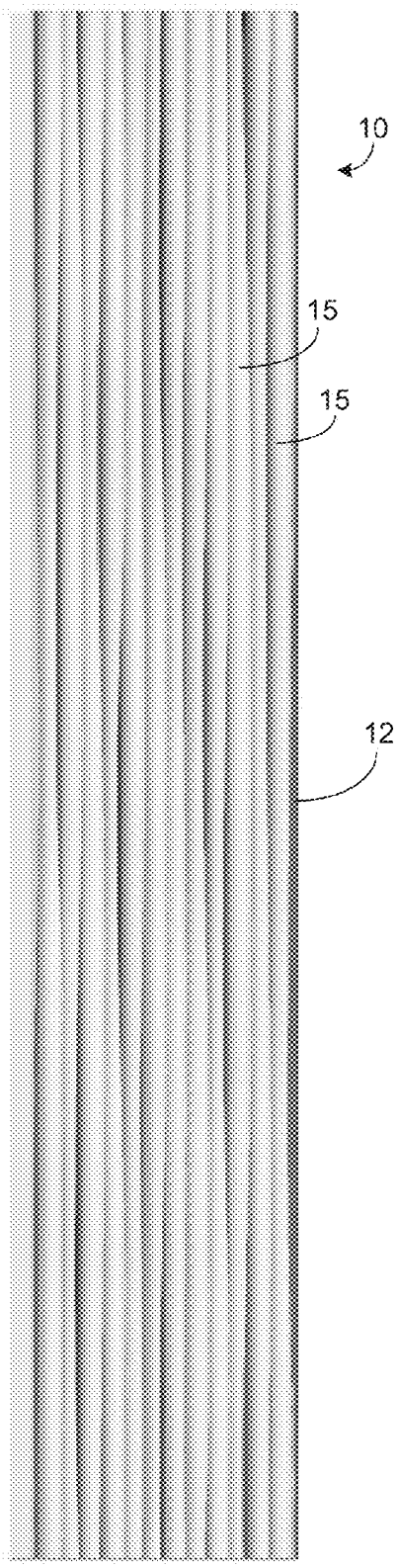
FIG. 2 is a top view of a first embodiment of an interlocking wall panel with a first example of a carved decorative texture.

Referring now to FIG. 2, a top view of an interlocking wall panel with a first embodiment of a carved decorative texture. The top textured surface 12 of the present embodiment comprises a plurality of decorative grooves that are substantially linear in the X-Y plane of the top surface. In this embodiment, the grooves are linear with a varied depth along their length. The decorative grooves of the present embodiment provide visual interest and light play. It should be appreciated in alternative example patterns the decorative grooves may vary in depth, width, orientation, linearity, length or other features and the pattern shown here is merely provided as an example.

Example decorative grooves may have a depth that is between about 1/32 and ¼ inches. Further, the decorative grooves may have a width that is between about ⅛ and ½ inches. In alternative embodiments, each of the decorative grooves may be formed so as to curve in two dimensions along its length. Additionally, each of the decorative grooves may be formed so as to curve in three dimensions along its length (e.g. a curved pattern with variable depth).

Figure 3:
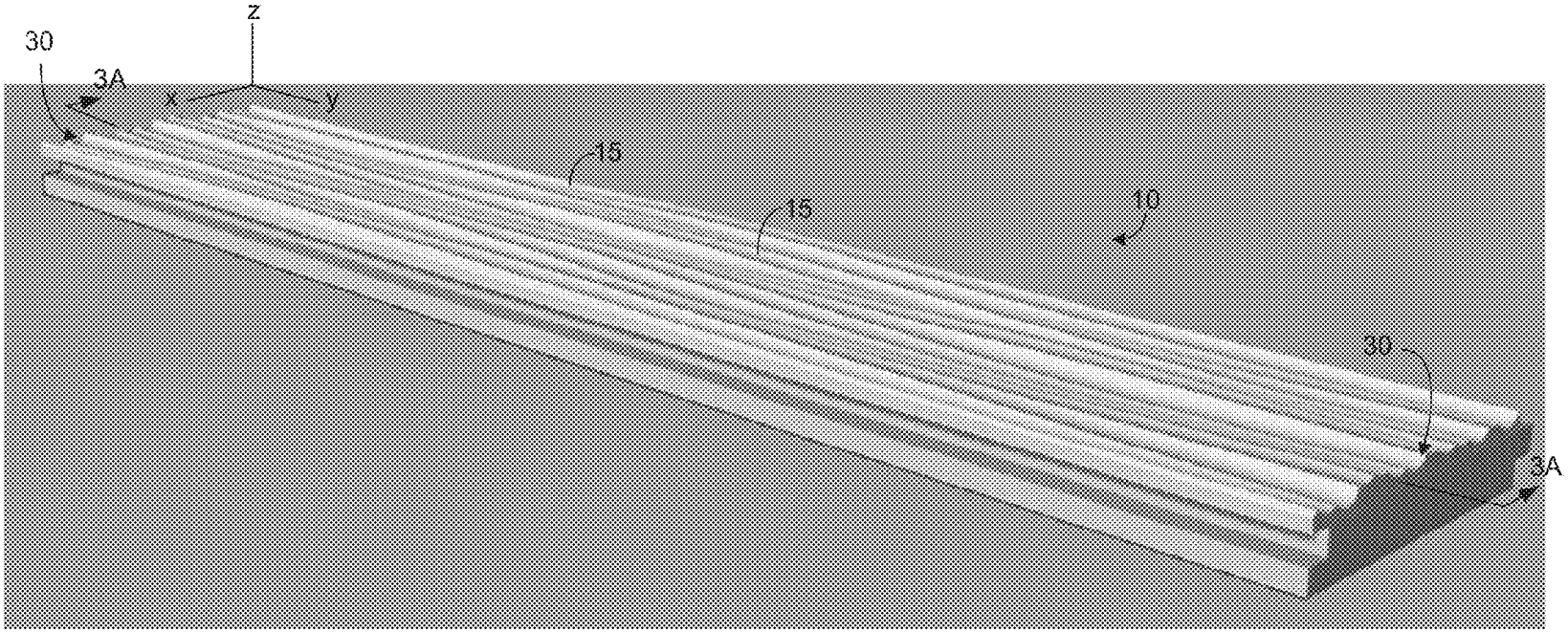
FIG. 3 is a front top perspective view of the interlocking wall panel of FIG. 2.

FIG. 3 shows a perspective top view of the interlocking wall panel with an example carved decorative texture seen in FIG. 2. In the present view, an end profile 30 is visible. In the end profile 30, the termination points of the decorative grooves are visible with varying depths. Each of the ends of the body include respective matching end profiles 30. When two interlocking wall panels are laid out end to end, the ends of each pair of adjacent panels meet with matching end profiles to form a seamless joint therebetween. This is described in greater detail below in reference to FIG. 7.

Figure 3A:
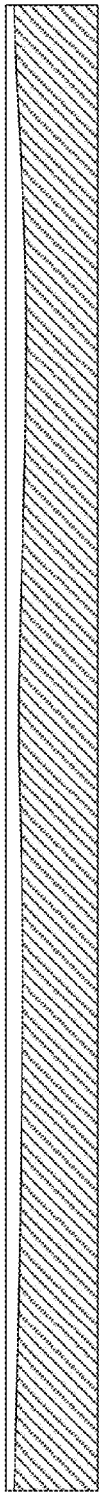
FIG. 3A is a cross-sectional view of the interlocking wall panel of FIG. 2, showing a groove with depth.

FIG. 3A illustrates a schematic view of a cross section of the FIG. 3. As can be seen, the depth of a linear groove formed in the top surface varies along the length of the groove, since the path of the groove is curvilinear, and curves in the depth direction, i.e., the Y-Z plane.

Turning now to FIG. 4, an end view of the interlocking wall panel with the first example carved decorative texture is shown. Matching end profile 30 is visible showing the varied depths of the decorative grooves. Furthermore, interlocking groove 14 and interlocking tongue 16 are shown. Each of the first and second sides of an interlocking wall panel includes a matching side profile 40. When assembled into an interlocking wall panel system a seamless joint is achieved between each of the adjacent pairs of rows of interlocking wall panels, due to the matching of the end profiles 30 and the side profiles 40. This is described in greater detail below in reference to FIGS. 6A and 6B.

Further, the cross section of an interlocking wall panel 10 may include a top layer of a first wooden material, and one or more lower layers of a second wooden material. The individual layers of wooden material may be comprised of varied types of wood or engineered wood materials as described above. The decorative grooves in the top surface may be formed entirely within the first layer of the first wooden material.

Figure 5:
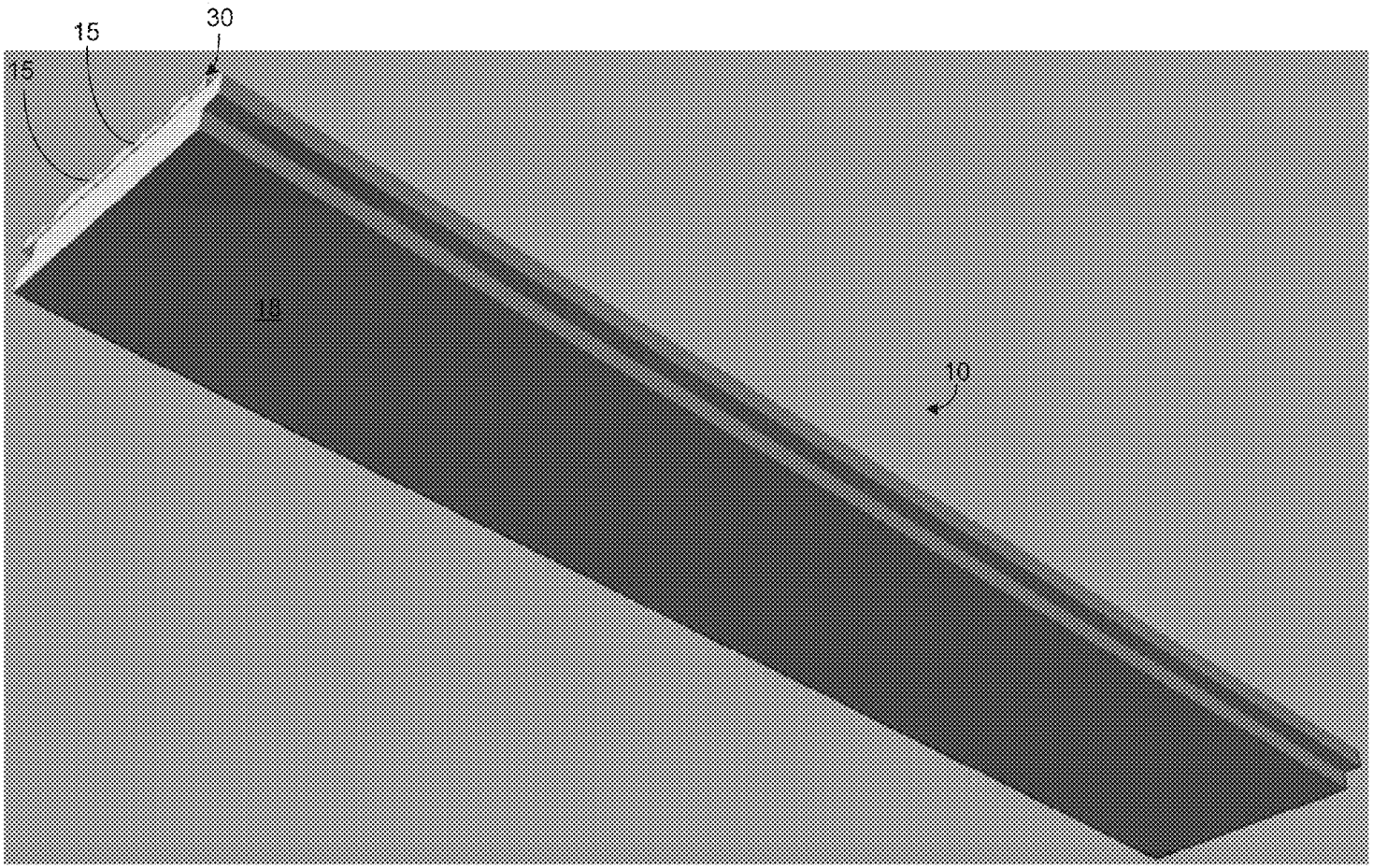
FIG. 5 is a bottom rear perspective view of the interlocking wall panel of FIG. 2.

FIG. 5 shows a perspective bottom view of the interlocking wall panel 10 with the first example carved decorative texture. The bottom 18 forms the wall or exterior facing surface of the interlocking wall panel 10 such that the opposing surface with the carved texture or pattern is visible in an interior space. The bottom 18 of the interlocking wall panel 10 is a flat surface in this specific example. The bottom 18 may be rough-hewn or otherwise unfinished as it does not face a room interior and furthermore slight texturing may provide a suitable substrate for any adhesives that may be applied in the assembly and installation of an interlocking wall panel system.

Figure 6A:
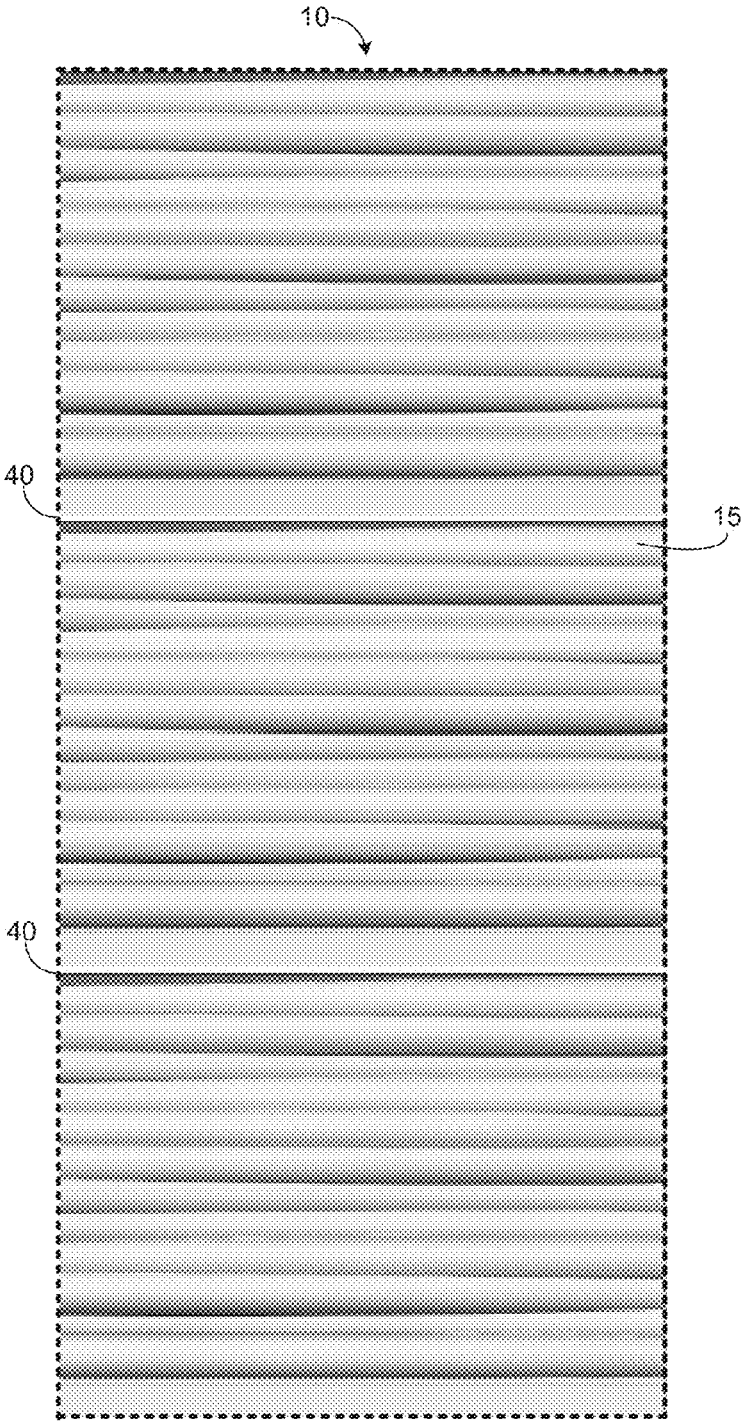
FIG. 6A is an assembly view showing an interlocking wall panel system comprised of interlocking wall panels of the embodiment shown in FIG. 2.
Figure 6B:
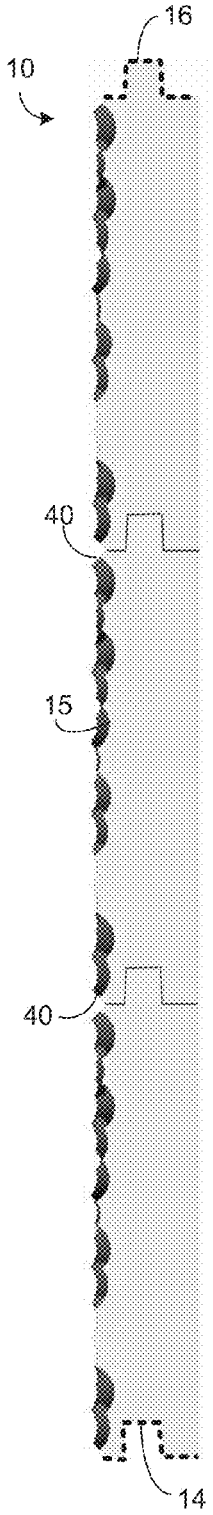
FIG. 6B an end view of the interlocking wall panel system of FIG. 6A.

FIGS. 6A and 6B show example sections of an interlocking wall panel system. Interlocking wall panels are arranged in stacked rows, each of the stacked rows including a subset of the interlocking wall panels laid out end to end, such that the ends of each pair of adjacent panels meet with matching end profiles to form a seamless joint therebetween, and wherein each pair of adjacent rows is interlocked in a tongue and groove connection between the interlocking tongues of the panels in a first of the pair of rows and the interlocking groove of the panels in a second of the pair of rows. The dotted lines of FIGS. 6A and 6B indicate the section may continue beyond the dotted line.

FIG. 6A shows a top surface of three stacked rows of interlocking wall panels 10. Each of the first and second sides of each of the panels in each of the rows includes a matching side profile 40, and as a result a seamless joint is achieved between each of the adjacent pairs of rows.

FIG. 6B shows an end view of three stacked rows of interlocking wall panels 10. Visible in the end view are interlocking grooves 14 and interlocking tongues 16. A profile of the interlocking groove and a profile of the interlocking tongue match. The shape of the interlocking groove and the interlocking tongue could be for example square, rectangular, dovetail, biscuit joint, or beveled. Matching side profiles 40 are shown at the seamless joint between individual interlocking wall panels.

Figure 7:
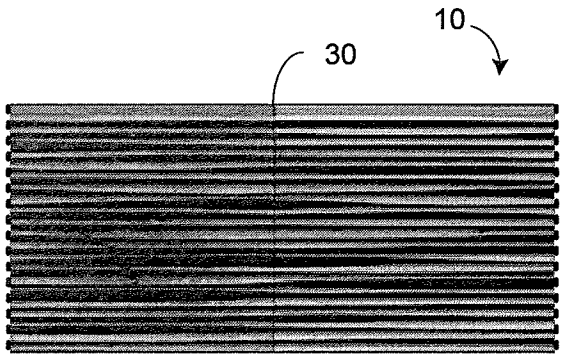
FIG. 7 is an example top view of an end joint between two interlocking wall panels of the interlocking wall panel system of FIGS. 6A and 6B.

FIG. 7 shows a top view of a single, example, stacked row of an interlocking wall panel system. The interlocking wall panels are laid out end to end, such that the ends of each pair of adjacent panels meet with matching end profiles 30 to form a seamless joint therebetween.

A single stacked row is shown in FIG. 7 but it should be appreciated that an interlocking wall panel system may comprise a plurality of stacked rows wherein each pair of adjacent rows is interlocked in a tongue and groove connection between the interlocking tongues of the panels in a first of the pair of rows and the interlocking groove of the panels in a second of the pair of rows. The panels may be laid out end to end and in multiple stacked rows such that an interlocking wall panel system may be extended to cover a wall, region of a wall, or other surface. Example layouts of interlocking wall systems are shown in FIGS. 8-10.

Figure 8:
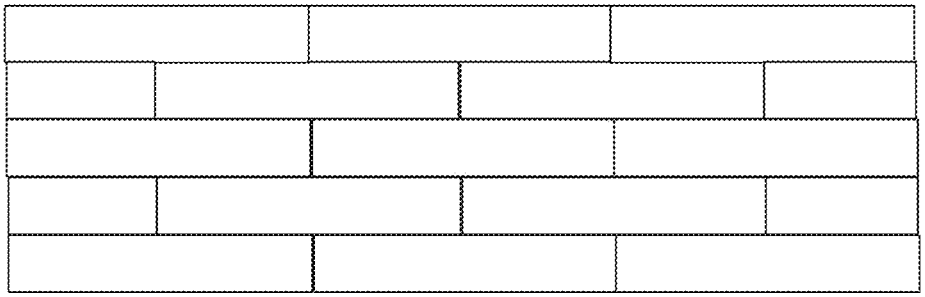
FIG. 8 is a first embodiment of a layout of interlocking wall panels assembled of the interlocking wall panel system of FIGS. 6A and 6B.

FIG. 8 is a first example layout of interlocking wall panels assembled in an interlocking wall panel system. In the first example layout adjacent rows are offset such that the seamless joint between matching end profiles lines up with the middle of an interlocking wall panel of an adjacent row. FIG. 9 is a second embodiment of a layout of interlocking wall panels assembled in an interlocking wall panel system. In the second embodiment of a layout adjacent rows are aligned such that the seamless joint between matching end profiles is in line with the seamless joint between matching end profiles of an interlocking wall panel of an adjacent row.

Figure 10:
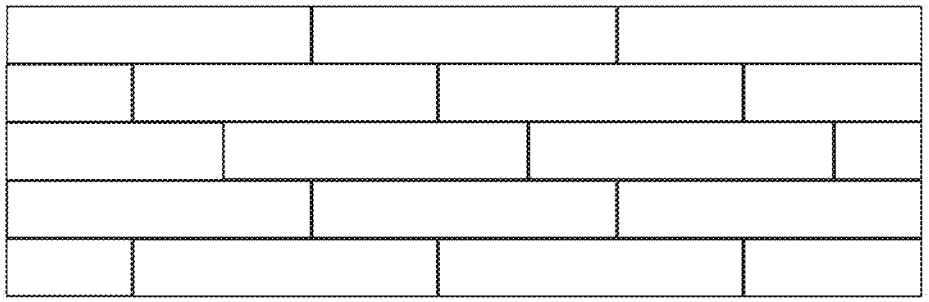
FIG. 10 is a third embodiment of a layout of interlocking wall panels assembled of the interlocking wall panel system of FIGS. 6A and 6B.
Figure 11:
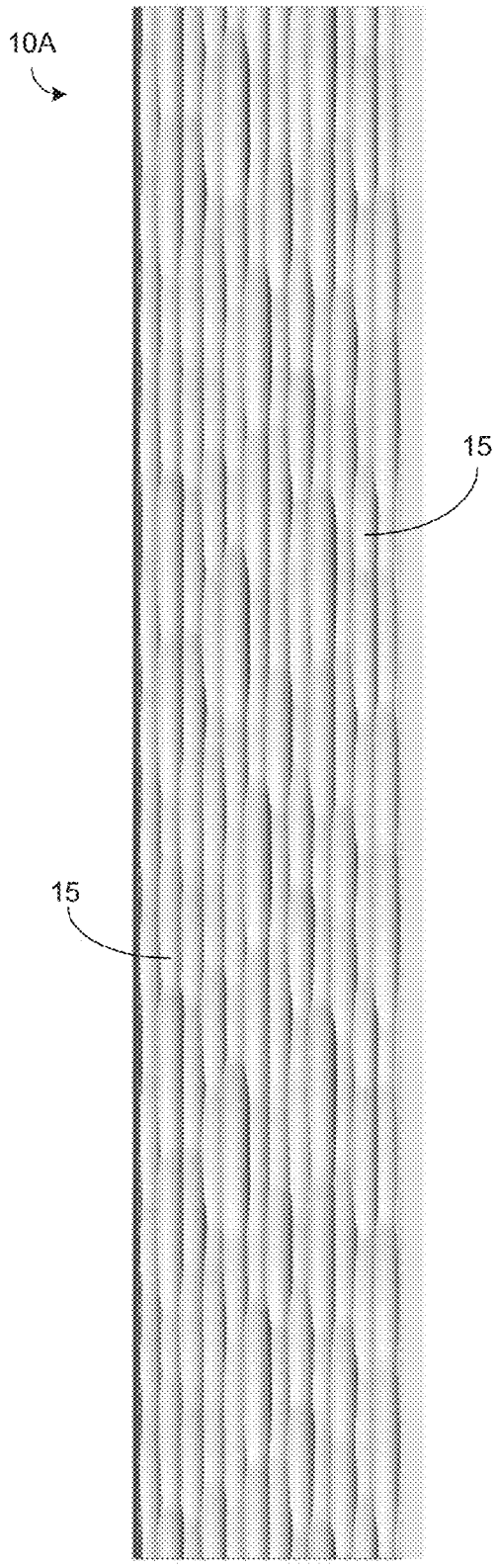
FIG. 11 is a top view of a second embodiment of an interlocking wall panel with a second example of a carved decorative texture.
Figure 12:
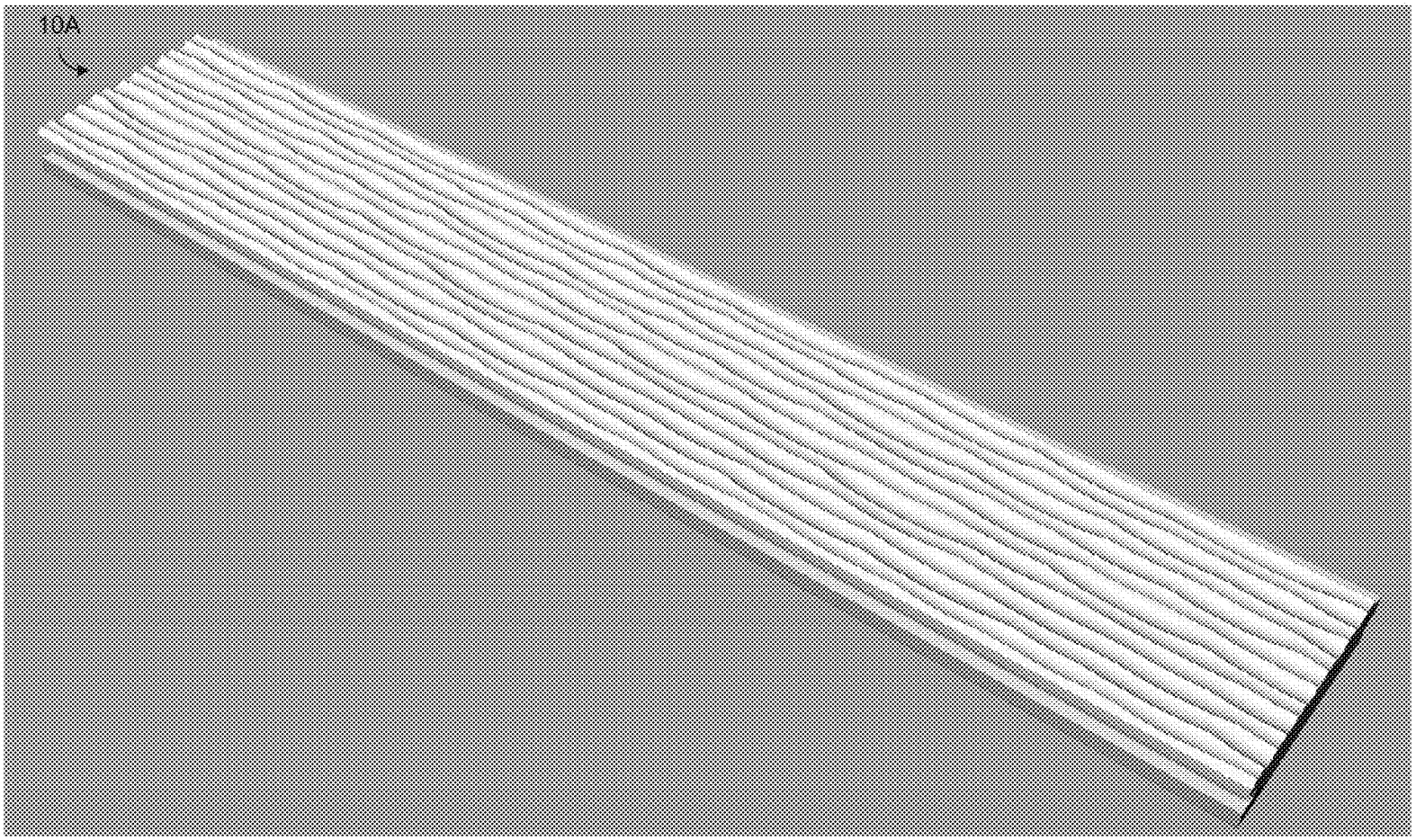
FIG. 12 is a top front perspective view of the interlocking wall panel of FIG. 11.

FIG. 10 is a third embodiment of a layout of interlocking wall panels assembled in an interlocking wall panel system. In third embodiment of a layout adjacent rows are aligned such that the seamless joint between matching end profiles is offset from the seamless joint between matching end profiles of an interlocking wall panel of an adjacent row. This offset could be of any distance, or variable distances between adjacent rows.

Figure 9:
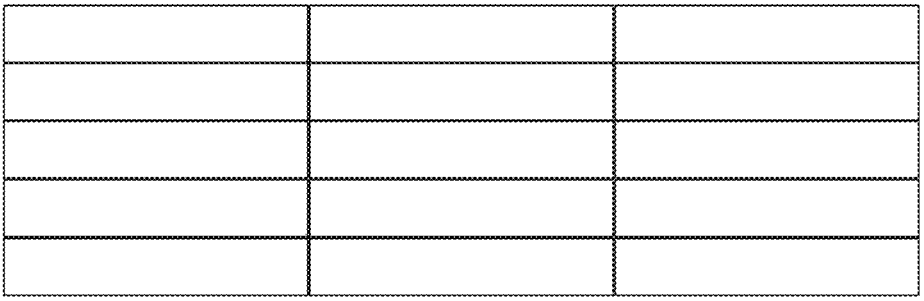
FIG. 9 is a second embodiment of a layout of interlocking wall panels assembled of the interlocking wall panel system of FIGS. 6A and 6B.

The embodiments of layouts provided in FIGS. 8-10 are provided as examples and it should be understood that many variations of alignment between adjacent rows is plausible and may be altered in accordance with a particular carved decorative texture to achieve optimal pattern alignment for visual interest. Furthermore, an interlocking wall panel system in accordance with the present disclosure may further be arranged with a long axis of an interlocking wall panel being vertical or on an angle is so desired. It will also be appreciated that the use of asymmetric side profiles and end profiles for the panels is possible, but this requires precise alignment of the panels in order to achieve a seamless appearance.

FIGS. 11-14 illustrate various views of a second embodiment of an interlocking wall panel 10A with a second example of a carved decorative texture. The pattern of the interlocking wall panel 10A features parallel decorative grooves 15 that vary in depth at regular intervals along their length. Adjacent grooves vary in their depth at a given length along the interlocking wall panel 10A. Furthermore, adjacent grooves have different patterns of variability in depth. In this second embodiment grooves are cut by a ball end mill. The depth of the mill into the wooden material varies resulting in a decorative groove that is wider in some areas along its length as a larger arc along the radius of the cutting tip is exposed to the wood.

Figure 13:
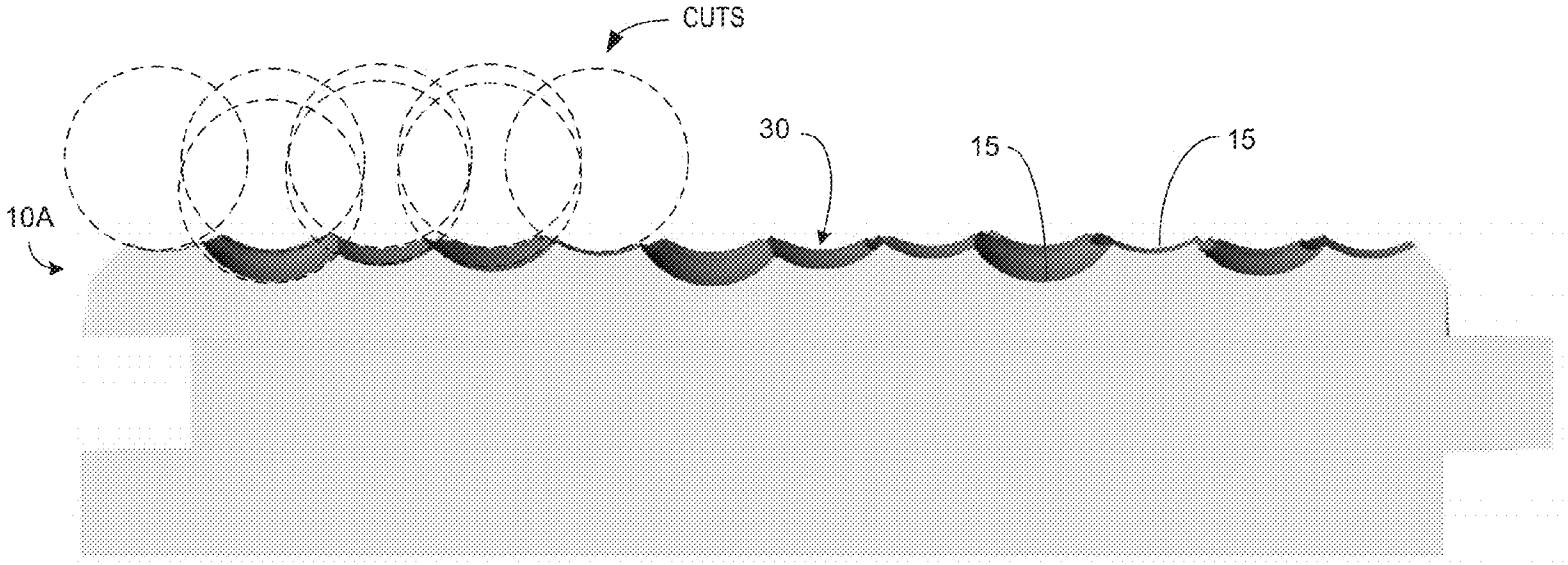
FIG. 13 is an end view of the interlocking wall panel of FIG. 11.
Figure 14:
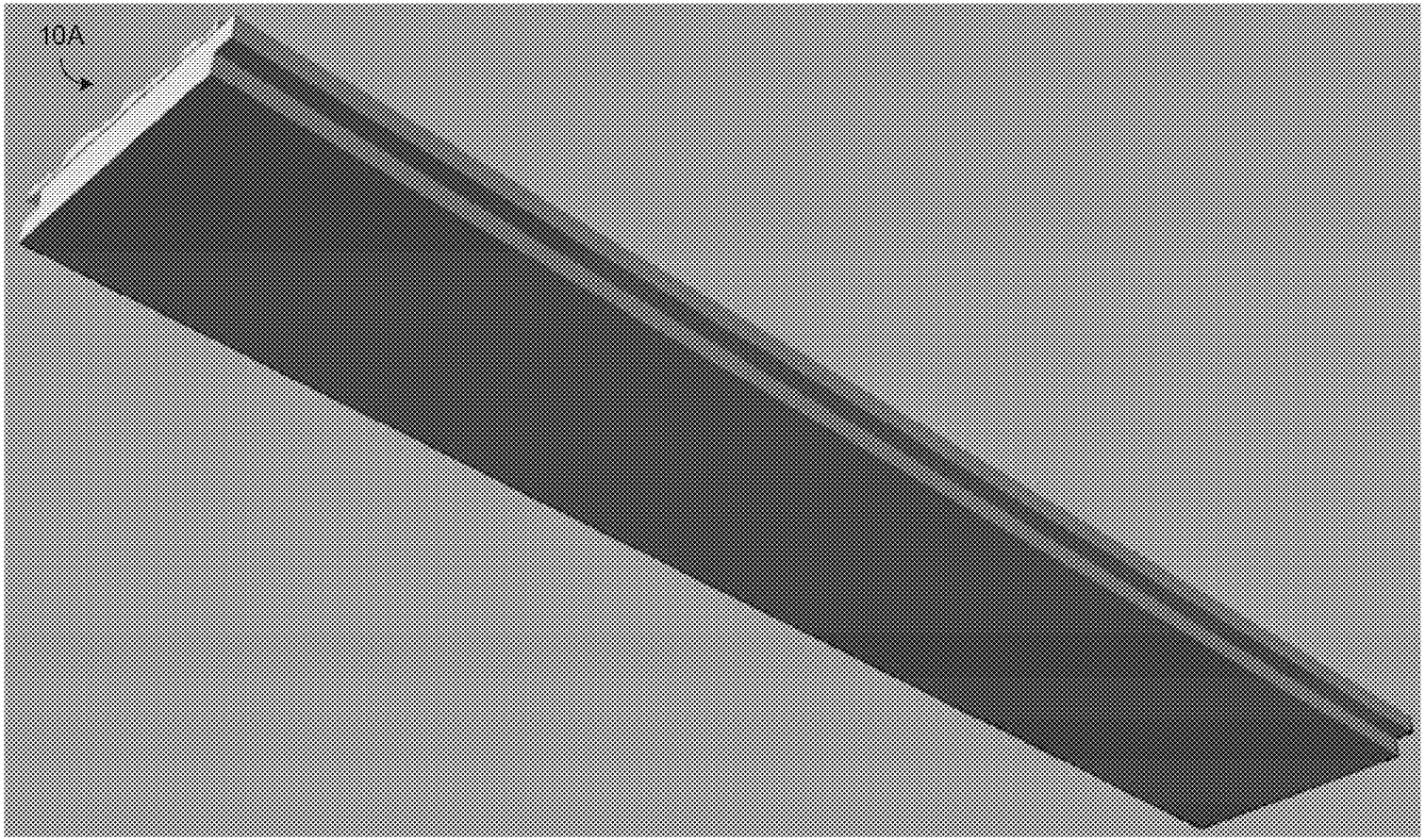
FIG. 14 is a bottom rear perspective view of the interlocking wall panel FIG. 11.

FIG. 13 illustrates the matching end profiles of the interlocking wall panel 10A. A plurality of cuts that form the decorative grooves 15 are illustrated by dashed lines, in the shape of the ball end mill that cut the grooves. The cuts are formed along parallel paths taken by the ball end mill during manufacturing. The unique appearance of the decorative texture is formed by cutting the grooves so that they have varying depths. Thus the path of each of the grooves curves in the Y-Z plane. The degree and pattern to this curvature in the depth direction differs between the first embodiment 10 and second embodiment 10A of the interlocking wall panel, giving each a unique appearance. Notably, all of the cuts are formed by a ball end mill having the same arc of the same radius, as shown in FIG. 13; however, the invention need not be so limited, as a CNC machine could change tools to use a tool of a different diameter, and cut some of the grooves so as to have an arc of a different radius.

Figure 15:
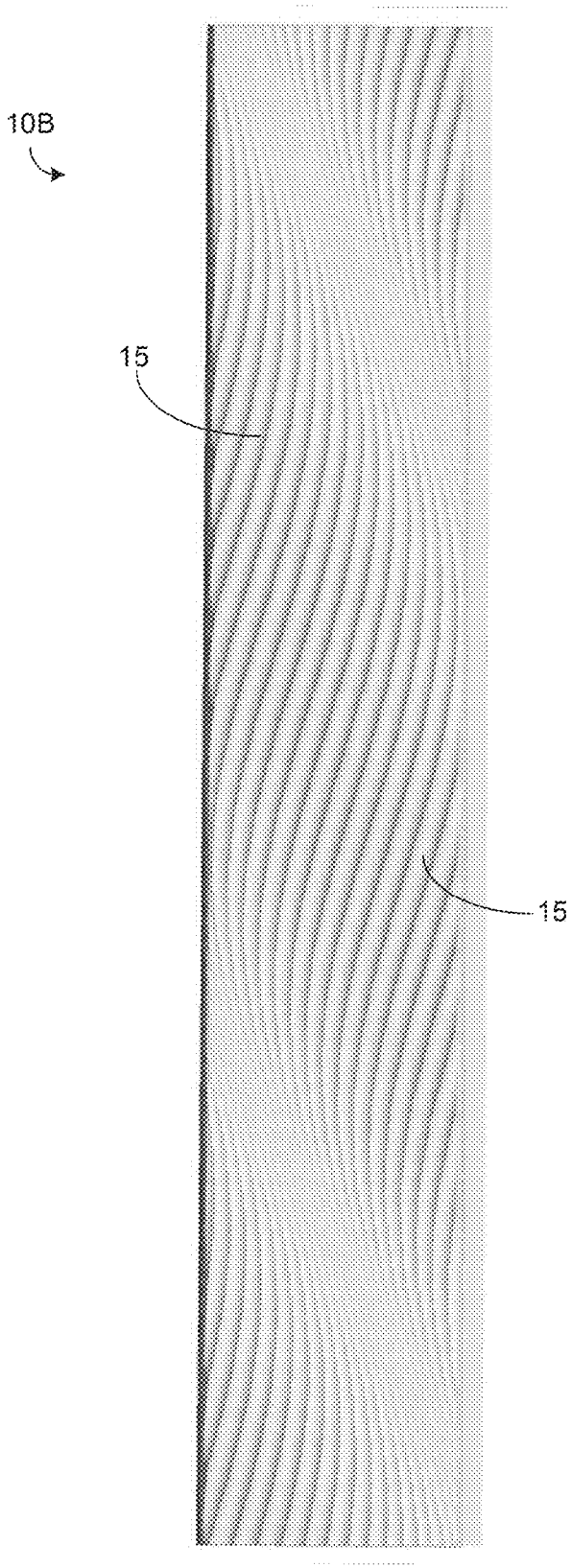
FIG. 15 is a top view of a third embodiment of an interlocking wall panel with a third example of a carved decorative texture.
Figure 16:
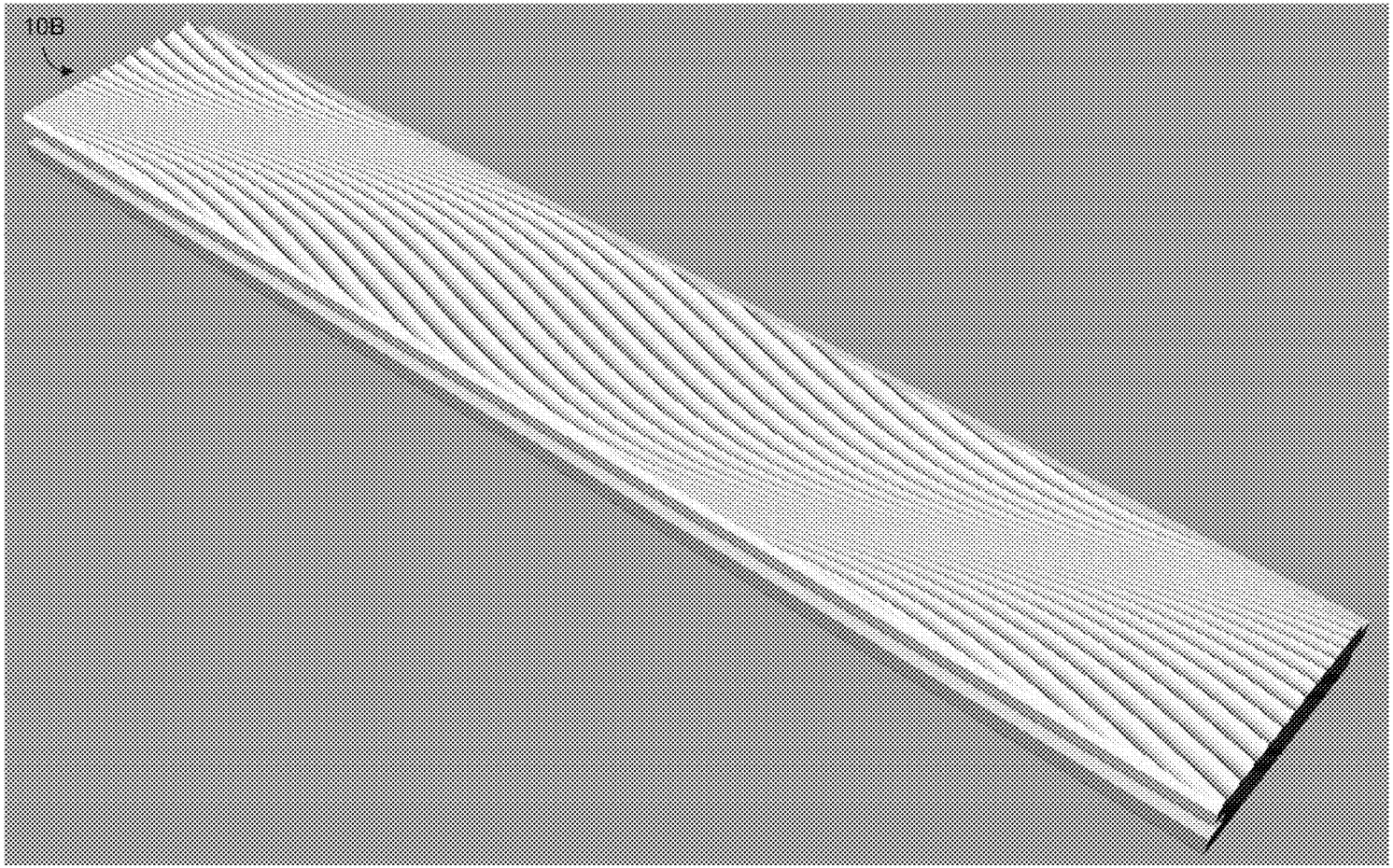
FIG. 16 is a perspective top view of the interlocking wall panel of FIG. 15.
Figure 17:
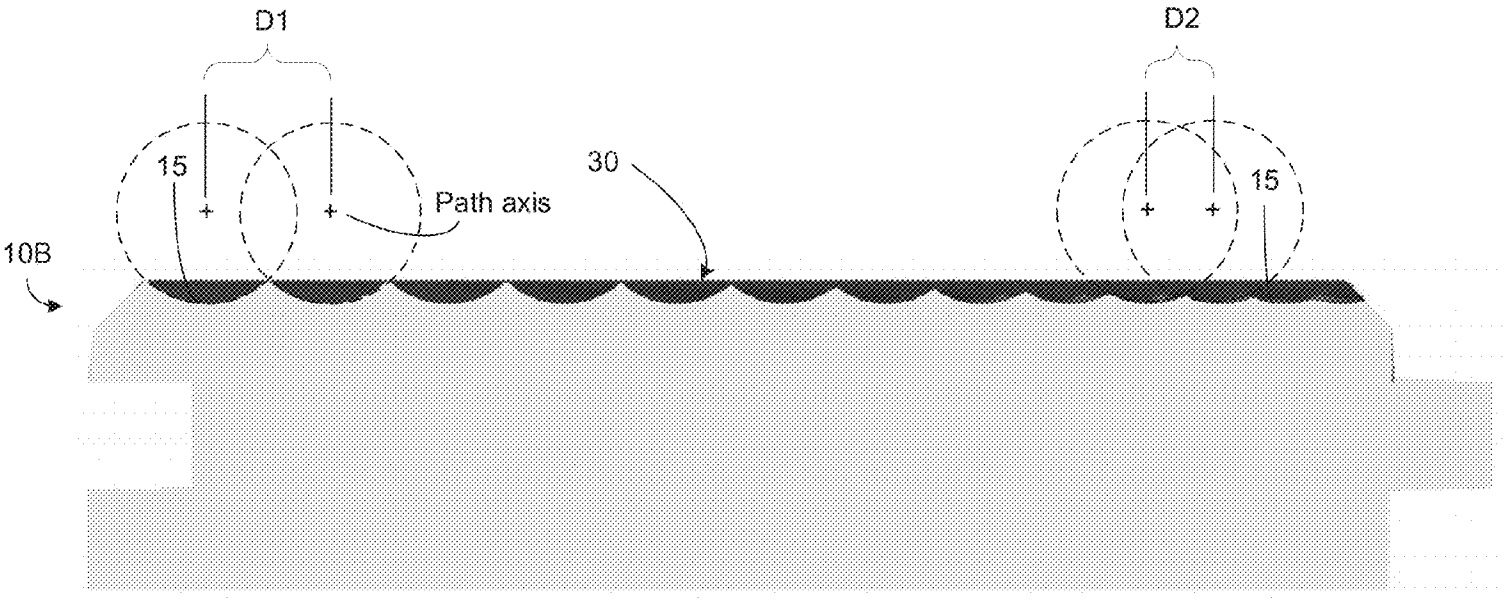
FIG. 17 is an end view of the interlocking wall panel of FIG. 15.
Figure 18:
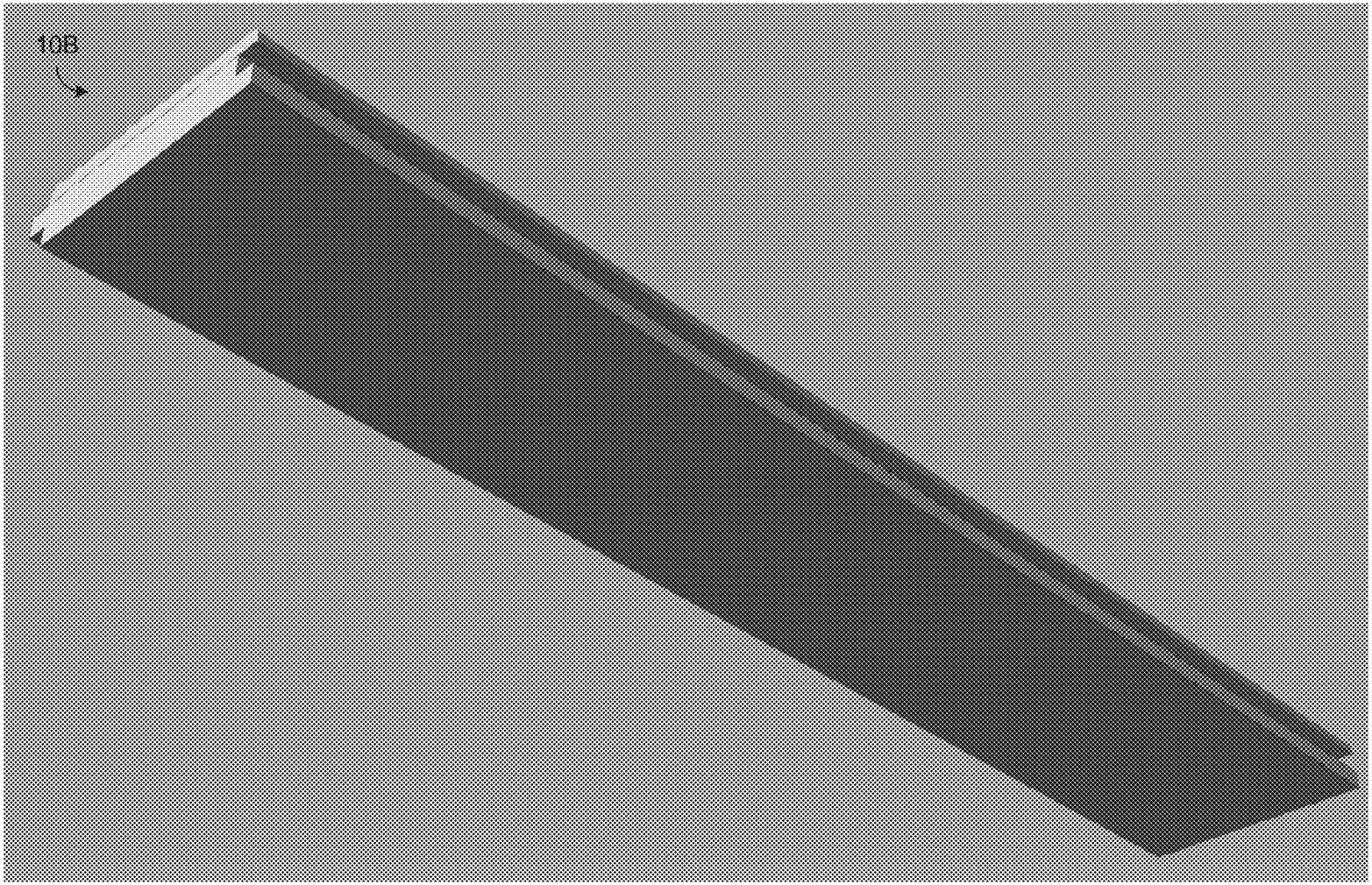
FIG. 18 is a perspective bottom view of the interlocking wall panel of FIG. 15.
Figure 19:
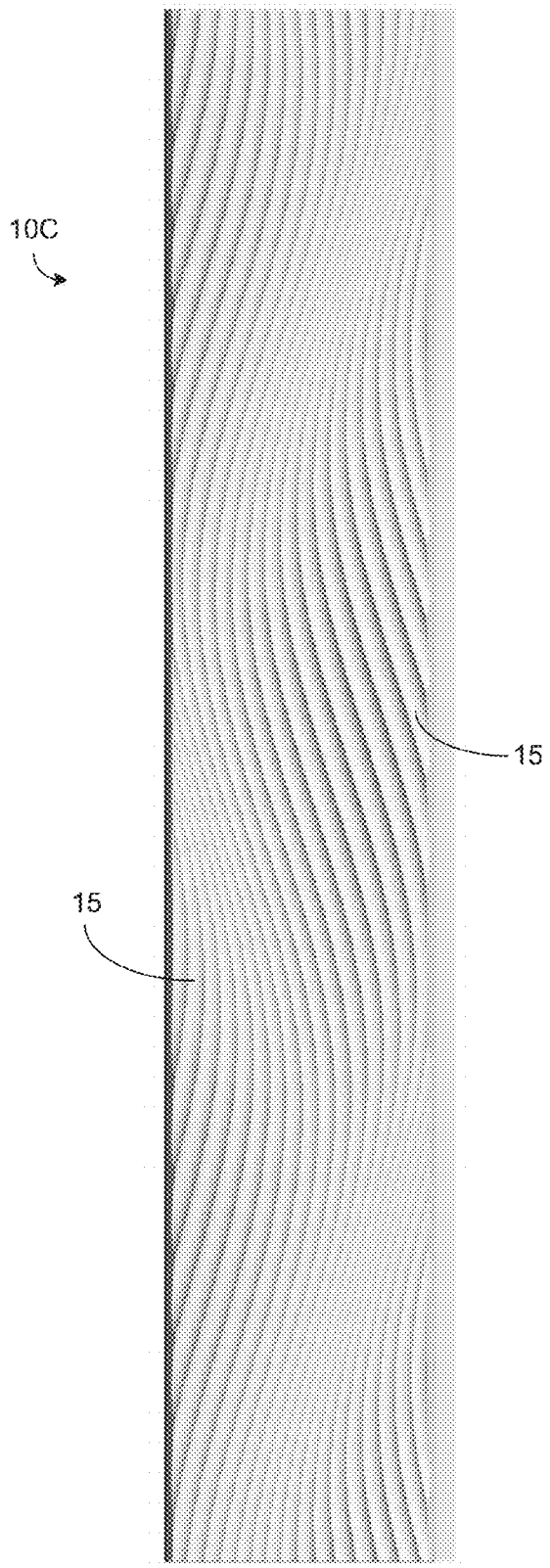
FIG. 19 is a top view of a fourth embodiment of an interlocking wall panel with a fourth example of a carved decorative texture.
Figure 20:
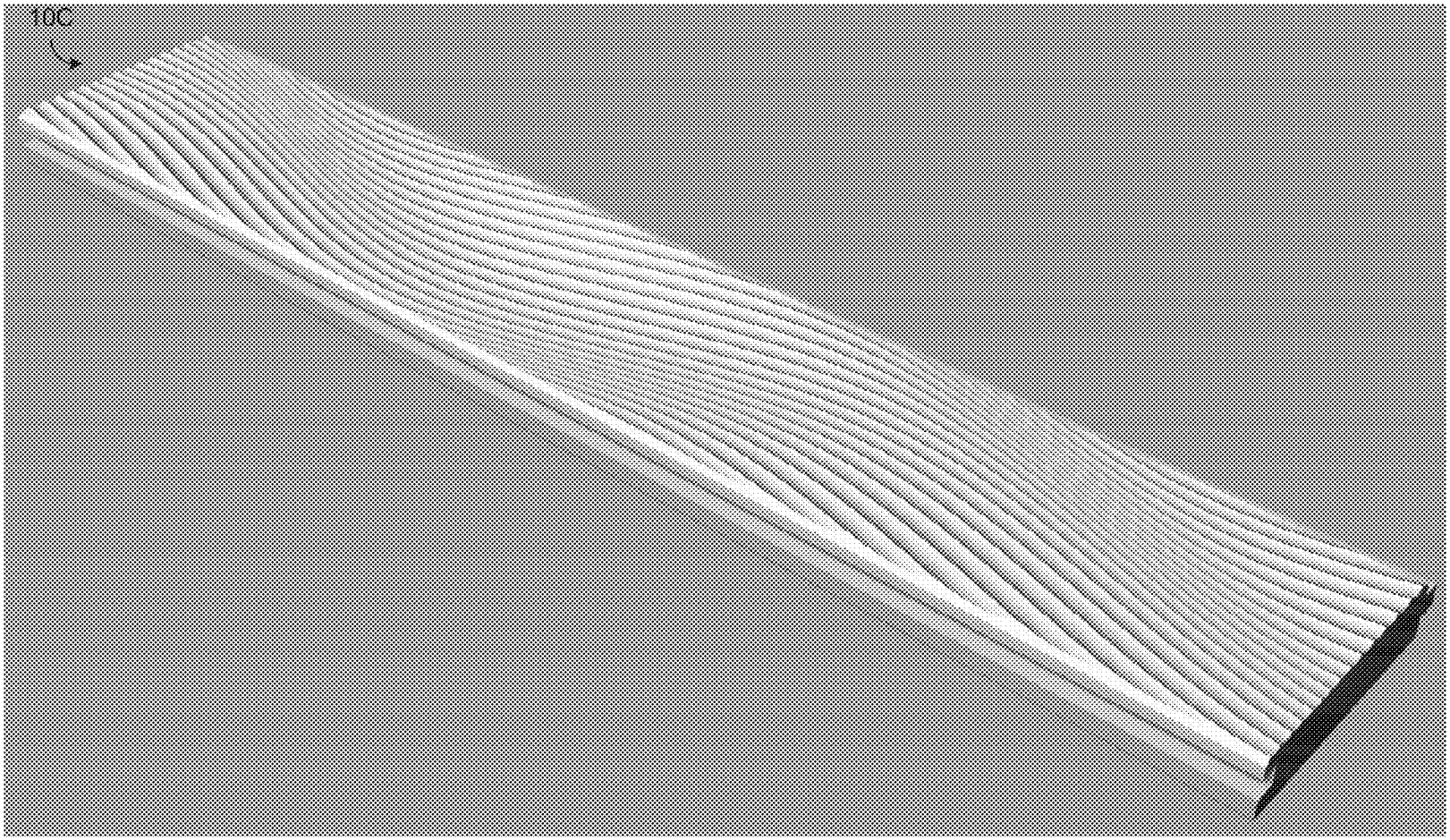
FIG. 20 is a top front perspective top view of the interlocking wall panel of FIG. 19.
Figure 21:
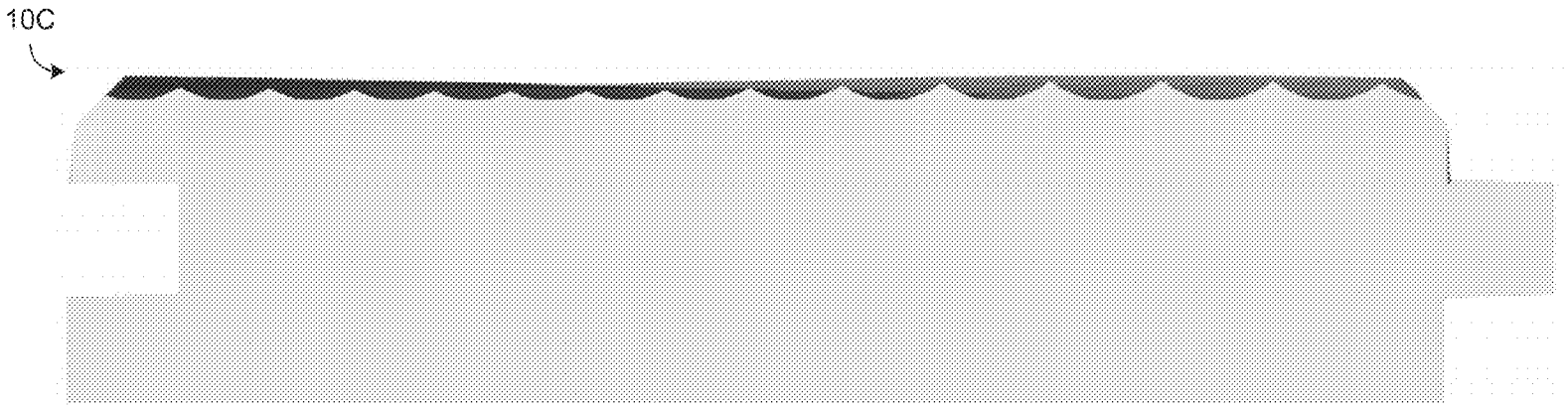
FIG. 21 is an end view of the interlocking wall panel of FIG. 19.
Figure 22:
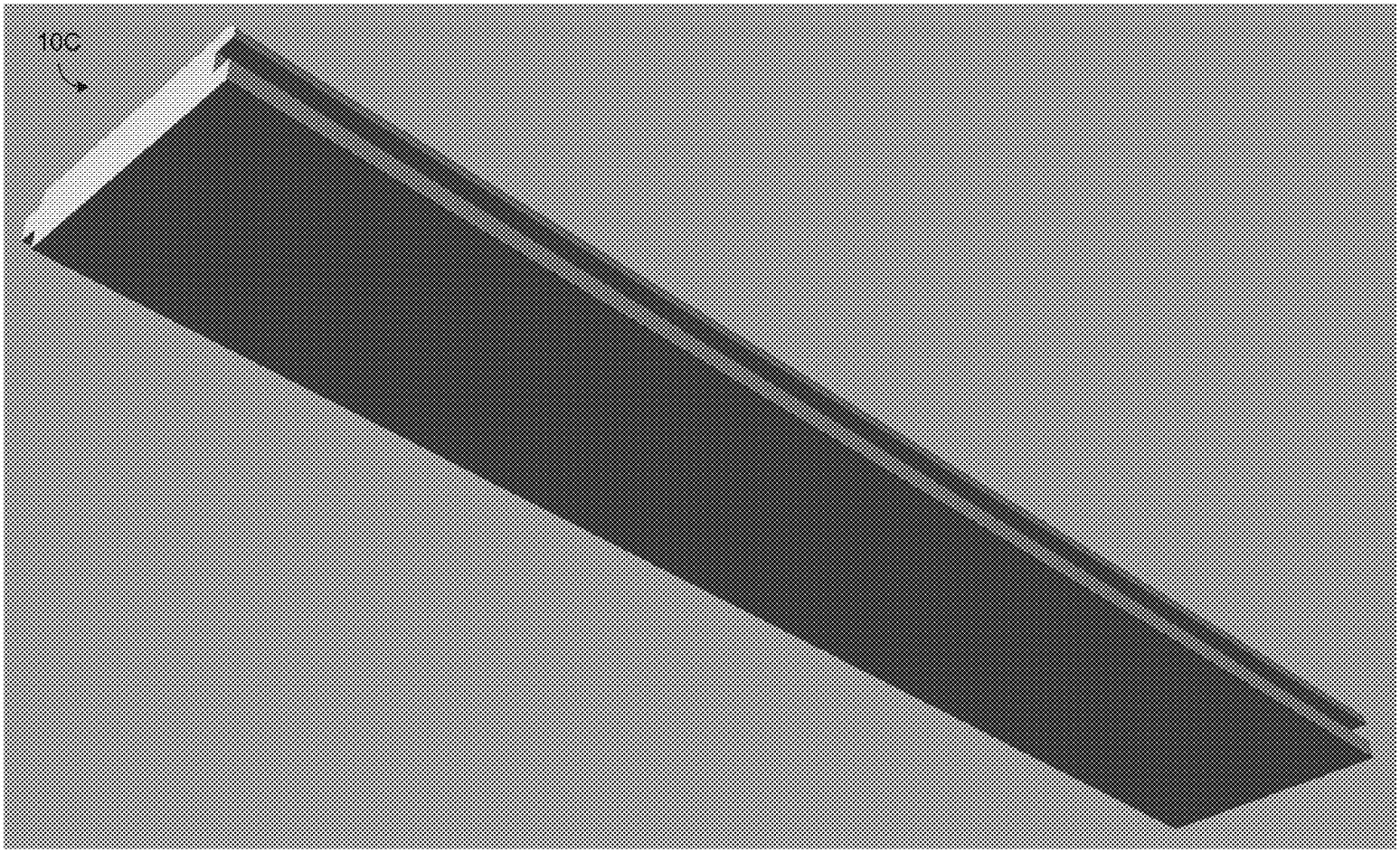
FIG. 22 is a bottom rear perspective bottom of the interlocking wall panel of FIG. 19.

FIGS. 15-18 are various views of a third embodiment of an interlocking wall panel 10B featuring a third example of a carved decorative texture. The pattern shown in the third embodiment features decorative grooves 15 that curve from side to side of the top surface of the interlocking wall panel. As shown in FIG. 17, to produce this decorative texture, the depth of the grooves is kept constant, but the lateral spacing between the path axes of each adjacent groove is varied. Thus, the distance D1 is greater than the distance D2. As the path axes come closer together the height of the sharp ridge formed between each groove slowly decreases, although the bottom of each groove remains at a constant depth. As shown in FIGS. 15 and 16, the lateral spacings between the grooves may be varied in a sinusoidal or wave pattern to produce a wave like visual effect, resembling waves with parallel peaks.

FIGS. 19-22 are various views of a fourth embodiment of an interlocking wall panel 10C with a fourth example of a carved decorative texture. As in the third embodiment of FIGS. 15-18, the decorative grooves 15 of the fourth embodiment curve from side to side of the top surface of the interlocking wall panel by varying the lateral spacing between adjacent grooves, and as a result the height of the ridges between each groove is caused to vary. However, as viewed in FIGS. 19 and 20, the decorative grooves of the fourth embodiment vary slightly in their pattern from the decorative grooves, resembling waves with curving rather than parallel peaks.

The above described interlocking wall panels and wall panel systems may be manufactured according to the following method. For each of a plurality of interlocking wall panels, the method may include providing a body comprising a wooden material, forming an interlocking groove in a first side of the body, forming an interlocking tongue extending from a second side of the body substantially parallel to the first side, forming a pair of opposed ends that form a perimeter of the body with the first and second sides, and forming a plurality of curvilinear decorative grooves in a top surface of the body, the decorative grooves vary in depth along their length, such that each of the ends of the body is formed to include a respective matching end profile, the plurality of decorative grooves forming a carved top surface of the body.

The method may further include assembling the plurality of interlocking wall panels to be arranged in stacked rows, each of the stacked rows including a subset of the panels laid out end to end, such that the ends of each pair of adjacent panels meet with matching end profiles to form a seamless joint therebetween, and wherein each pair of adjacent rows is interlocked in a tongue and groove connection between the tongues of the panels in a first of the pair of rows and the groove of the panels in a second of the pair of rows.

The method may further include assembling the plurality of interlocking wall panels to be arranged such that each of the first and second sides of each of the panels in each of the rows includes a matching side profile, and as a result a seamless joint is achieved between each of the adjacent pairs of rows.

The above described panels, panel systems, and manufacturing methods may provide an aesthetically pleasing yet easy to manufacture wall covering, which exhibits superior light play and sound absorbing qualities, which is also more economical to produce than prior products.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A method for use in manufacturing and assembling an interlocking wall panel system, comprising:

for each of a plurality of interlocking wall panels:

providing a body comprising a wooden material;

forming an interlocking groove in a first side of the body;

forming an interlocking tongue extending from a second side of the body substantially parallel to the first side;

forming a pair of opposed ends that form a perimeter of the body with the first and second sides; and cutting a plurality of curvilinear decorative grooves in a top surface of the body through milling with a machine along respective paths such that ridges are formed between the grooves at intersections of the paths as viewed in cross section, the decorative grooves vary in depth along their length and the height of the ridges vary along their length, such that each of the ends of the body is formed to include a respective matching end profile, the plurality of decorative grooves forming a carved top surface of the body.

2. The method of claim 1, further comprising:

assembling the plurality of interlocking wall panels to be arranged in stacked rows, each of the stacked rows including a subset of the panels laid out end to end, such that the ends of each pair of adjacent panels meet with matching end profiles to form a seamless joint therebetween, and wherein each pair of adjacent rows is interlocked in a tongue and groove connection between the tongues of the panels in a first of the pair of rows and the groove of the panels in a second of the pair of rows.

3. The method of claim 2, further comprising:

assembling the plurality of interlocking wall panels to be arranged such that each of the first and second sides of each of the panels in each of the rows includes a matching side profile, and as a result a seamless joint is achieved between each of the adjacent pairs of rows.

4. The method of claim 1, wherein each of the plurality of decorative grooves is formed at a different depth.

5. The method of claim 1, wherein each of the plurality of decorative grooves is formed at a different width.

6. The method of claim 1, wherein the decorative grooves include compound grooves that are comprised of at least two grooves formed on top of each other.

7. The method of claim 1, wherein each of the decorative grooves has a depth that is between about 1/32 and 1/4 inches.

8. The method of claim 1, wherein each of the decorative grooves has a width that is between about 1/8 and 1/2 inches.

9. The method of claim 1, wherein each of the decorative grooves is formed so as to curve in two dimensions along its length.

10. The method of claim 1, wherein each of the decorative grooves is formed so as to curve in three dimensions along its length.

11. The method of claim 1, wherein the body includes a top layer of a first wooden material, and one or more lower layers of a second wooden material, and wherein the decorative grooves in the top surface are formed entirely within the first layer of the first wooden material.

12. The method of claim 1, wherein the wooden material is dimensioned lumber having a cross-sectional bounding box aspect ratio of a size selected from the group consisting of 1"×4", 1"×6", 1"×8", and 1"×10".

13. The method of claim 1, wherein the wooden material is solid wood.

14. The method of claim 1, wherein the wooden material is an engineered wood product selected from the group consisting of medium density fiber board, oriented strand board, plywood, particle board, glued laminated timber, laminated veneer lumber, parallel strand lumber, and laminated strand lumber.

15. The method of claim 1, wherein a profile of the interlocking groove and a profile of the interlocking tongue match.

16. The method of claim 1, wherein the matching profile of the interlocking groove and the interlocking tongue are formed in a shape selected from the group consisting of: square, rectangular, dovetail, biscuit joint, and beveled.

* * * * *